United States Patent [19]

Walter

[11] 4,447,917

[45] May 15, 1984

[54] WATER PRESSURE JET CLEANER

[76] Inventor: Klaus Walter, Priener Str. 28a, 8201 Eggstätt, Fed. Rep. of Germany

[21] Appl. No.: 394,269

[22] Filed: Jul. 1, 1982

[51] Int. Cl.[3] ..... E03D 11/00

[52] U.S. Cl. ..... 4/256; 4/255; 239/548; 239/556; 239/602; 285/8; 134/167 C

[58] Field of Search ..... 4/256, 255, 257; 24/249 R, 339, 332, 254, 252; 239/548, 556, 565, 602, DIG. 13, 450, 536; 285/8, 256; 134/167 C, 168 C

[56] References Cited

U.S. PATENT DOCUMENTS

| | | | |
|---|---|---|---|
| 608,207 | 8/1898 | Merritt | 4/255 |
| 2,001,230 | 5/1935 | Wayne | 4/256 |
| 2,061,553 | 11/1936 | Acosta | 4/256 |
| 2,197,716 | 4/1940 | Whitaker | 4/256 |
| 2,570,546 | 10/1951 | Hamlett | 4/256 |
| 2,583,694 | 1/1952 | Fulton | 4/256 |
| 2,626,405 | 1/1953 | Keith | 4/256 |
| 3,937,404 | 2/1976 | Johnson | 4/256 X |

*Primary Examiner*—Henry K. Artis

*Attorney, Agent, or Firm*—Orrin M. Haugen; Thomas J. Nikolai

[57] ABSTRACT

In order to create a water pressure jet cleaner, especially for clogged sinks, which is as simple as possible, quick and handy to use and which can be used with the most widely differing water faucets, it is equipped with a connecting hose (11) with a connecting adapter (7), which can be attached by means of a clamping device (32, 27–31). A cleaning head (13) is provided at the other end of the connecting hose (11).

8 Claims, 7 Drawing Figures

WATER PRESSURE JET CLEANER

BACKGROUND OF THE INVENTION

The invention relates to a water pressure jet cleaner, especially for clogged sinks and the like, which utilizes a connecting hose for coupling to the pressurized water supply, and with a cleaning head arranged at the free end of a connecting hose.

It is sufficiently well-known that, in particular, sink drains can easily become clogged. In order to open up the drain in such a case, it is known, among other things, to make use of chemical agents, In addition, also having become known are rubber plungers which, when compressed, are intended to produce an increase in pressure in the sinks and thus loosen the clog.

However, use, over a period of time, of chemicals containing acids corrodes, among other things, the sinks also and, in addition, a clog cannot always be eliminated successfully by this method.

But even the use of rubber plungers or suction devices does not always suffice to satisfactorily loosen a clog.

Already known is how to free clogged drains, for example in wash basins, dish washing sinks, etc., by utilizing the pressure in the water pipe system. However, such devices have not, up until this time, been found to be satisfactory in actual use.

SUMMARY OF THE INVENTION

The object of the invention is to create a water pressure jet cleaner that can be used in simplest fashion and that is easy to manipulate for freeing clogged drains quickly by utilizing the pressure in the water pipe system. The task for the invention is resolved in accordance with the features described herein. Advantageous developments of the invention are listed in the subclaims.

Through cooperation of numerous characteristics, actually created by means of the invention is a water pressure jet cleaner that is easy to operate, easy to use and whose effectiveness is clearly improved over the state of the art.

In an advantageous form of an embodiment of the invention the cleaning head displays one or several water exits or tubes that can reach down into the sink trap, or siphon, which are inserted through the drain strainer, for example in a wash basin. On the one hand, water pressure is built up and, on the other hand, water recirculation can be achieved lower down in the drain for the purpose of loosening the clog.

An optimal matching to differing drains and sink strainers is achieved by the fact that the water exit tubes are flexible, or at least partially flexible, so that they can be introduced and/or inserted into the most widely differing systems in such a way that they can be easily pushed together or apart.

In an advantageous form of an embodiment of the invention, the water exit tubes are arranged in the cleaning head in longitudinally displaceable fashion in order to permit an adjustment also with respect to the depth of the drain.

In a further development of the invention the cleaning head includes a retaining block, preferably in the form of a solid block, in which the water exit pipes are held. In this case, the water exit tubes can be arranged in this solid block in fitted openings or borings, so that they are held axially displaceable.

In order to ensure an optimal pressure build up in a clogged drain, a sealer plate is located below the cleaning head, and the water exit tubes pass through it. An optimal sealing effect is achieved by simply pressing the cleaning head against a clogged drain, so that the entire system water pressure can build up in the clogged drain.

In one preferred form of an embodiment of the invention, the connecting adapter is fashioned as a flexible, water tight and adequately pressure resistant hose. This ensures, in a particularly favorable fashion, that this connecting adapter can be connected to widely differing water faucets without the need for additional adaptation. In addition, this allows using the water pressure jet cleaner in accordance with the invention with the most widely differing water faucets.

In order to increase the resistance to pressure and thus total stability, the connecting adapter can be provided with an additional outer skin, directly attached or in form of an additional hose.

In a further development of the invention, a clamping device is used as a sleeve that can be secured with a screw.

In an alternative form of an embodiment, the clamping device consists of two parts which can be adjusted axially toward each other and which contain, on the inside, a pressure element whereby, through the axial movement of the two clamp parts toward each other, this axial movement is translated into a transverse pressure movement against the connecting adapter, which can thus be attached to a water faucet with any desired pressure. This clamping device can be operated particularly easily and quickly and, in addition, it can be used for different water faucets.

In a further development of the invention, an additional locking device is provided so that the clamping device is automatically held in the closed position after it has been actuated. It can easily be unlocked again through an appropriate unlocking device.

Further details, advantages and characteristics of the invention are obtained with the aid of the examples of embodiment illustrated by the drawings.

IN THE DRAWINGS

FIG. 1: schematic view of the water pressure jet cleaner in use on a wash basin.

FIGS. 2*a* and 2*b*: a perspective view of the cleaning head and the connector.

FIG. 3: a sectional view of the cleaning head.

FIG. 4: a sectional view of a first example of embodiment of a clamping device.

FIG. 5: another example of embodiment of a clamping device.

FIG. 6: another development of a clamping device.

DESCRIPTION OF THE PREFERRED EMBODIMENT

Figure 1:
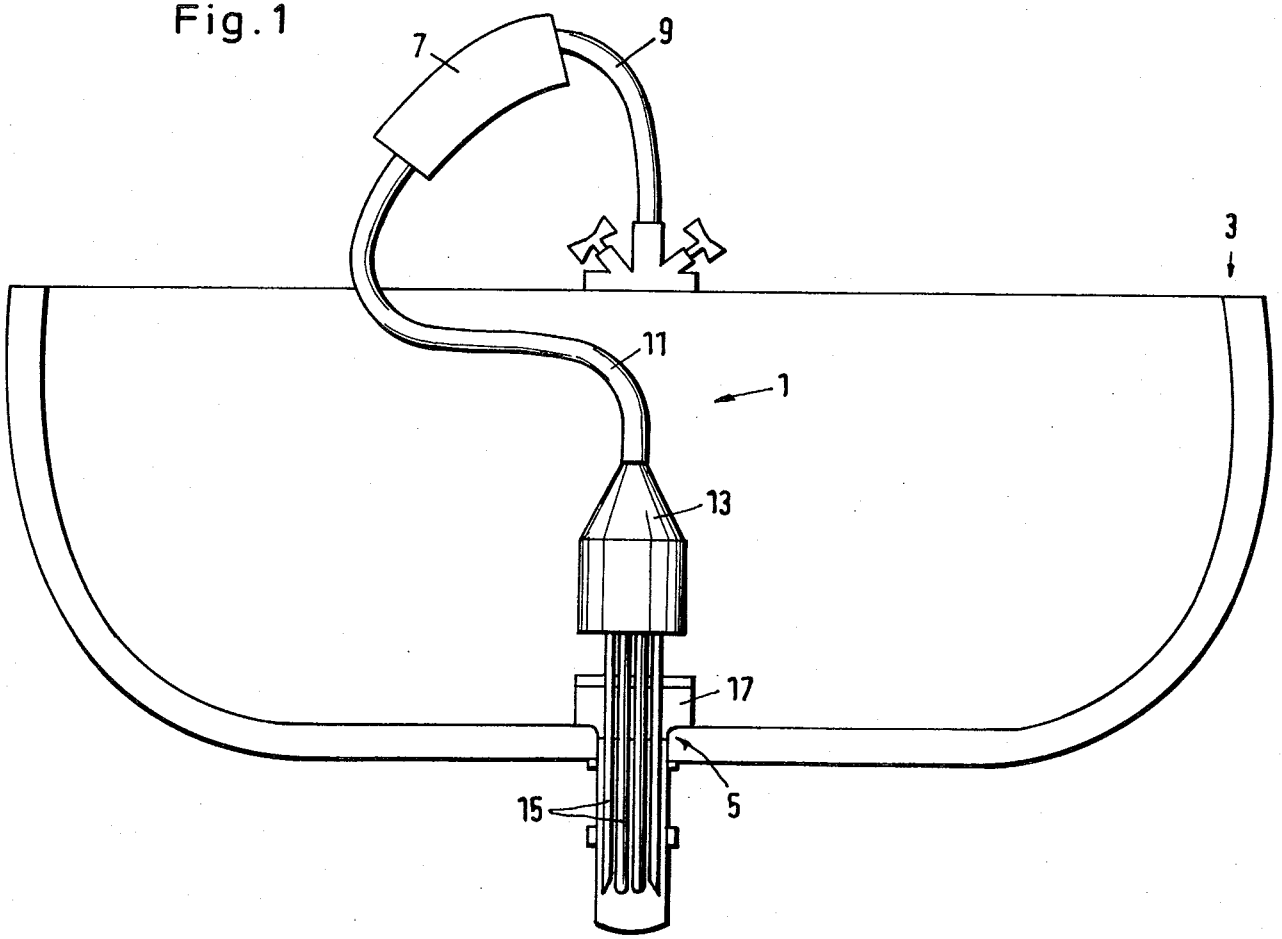

Shown in FIG. 1 is a water pressure jet cleaner 1 used in a wash basin 3 with a drain 5, where a clog must be eliminated. For that purpose, the water pressure jet cleaner 1 is connected to a water faucet 9 with its connecting adapter 7. In the example of the embodiment shown, six water exit tubes 15 project out from the cleaning head 13 which is to be inserted into the drain 5. Since the water exit tubes 15 are flexible, or at least partly flexible, which permits changing the radius through lateral movement, they can be inserted into sink strainers of a given design, so that the sink strainer can be thusly penetrated. This is accomplished by bending the partially flexible water exit tubes slightly outwardly or inwardly which bring about the needed adjustment to a sink strainer. The number, length and diameter of the water exit tubes can vary as required. A usual diameter could, for example, be about 6 mm. This design allows the water pressure to be effective in the area of the drain without impediment or reduction. The water exit tubes 15 could, for example, also display an oval cross section.

Figure 2B:
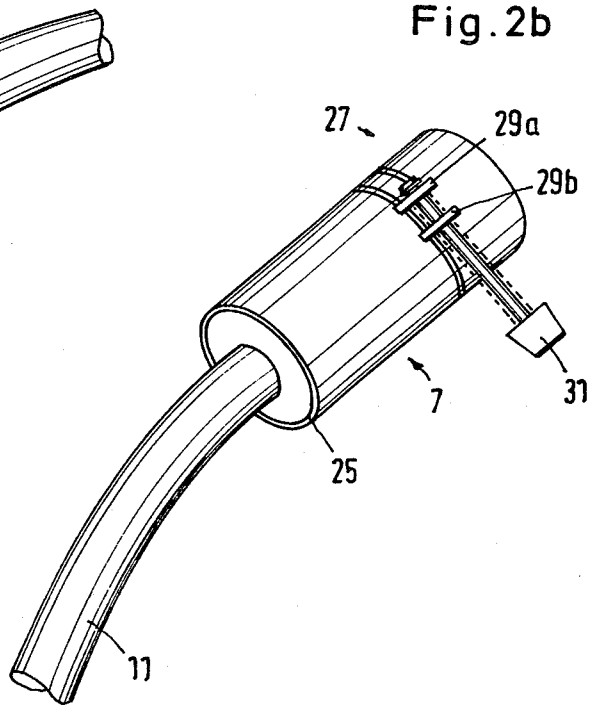
Figure 2A:
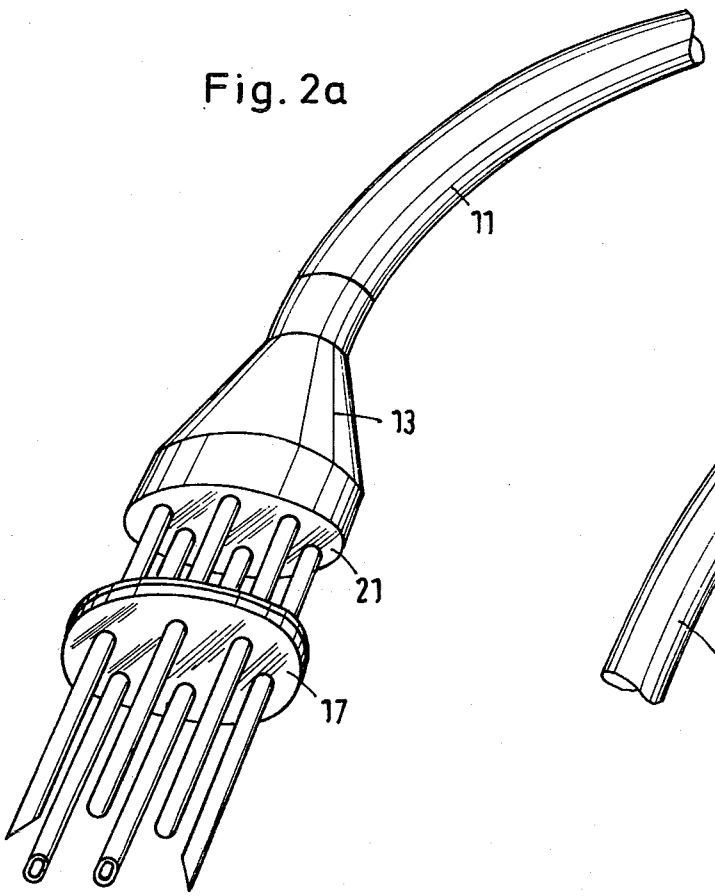
Figure 3:
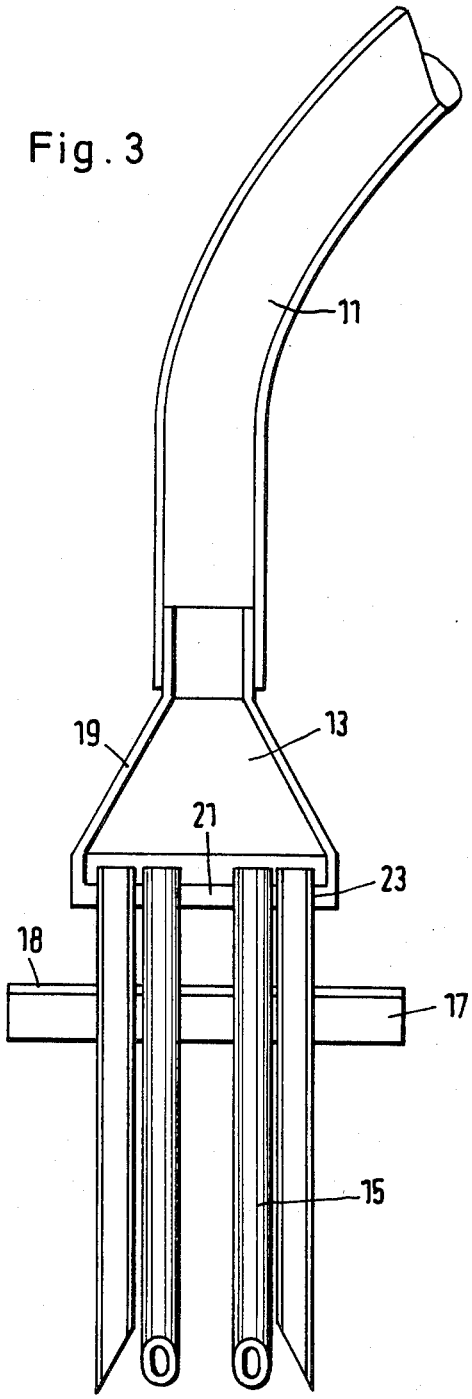

The following refers to FIGS. 2*a* and 3 which show the cleaning head 13 in a sectional view.

The cleaning head 13 consists principally of a funnel-shaped housing 19 whose upper intake end is permanently connected to the connecting hose 9. This can be a one-piece design. However, it is also possible to slip the connecting hose 9 over its end and to fix it firmly, with clamps for example.

In opposed arrangement is a retaining block 21 with several fitted borings 23, through which the water inlet tubes 15 extend. The design can be such that the water exit tubes 15 can be pushed through these borings in order to vary the outside excess length of the water exit tubes. The water exit tubes 15 are cut at an angle at the lower end. The arrangement of partially flexible water exit tubes 15, for example in the form of plastic tubes, is circular, whereby the size of the retaining block 21, for example, can amount to a diameter of 36 mm and a height of 25 mm. The small exit tubes themselves can be, for example, 4–20 cm or longer.

Provided additionally is the sealer plate 17, which is penetrated by the water exit tubes 15 as well. This sealer plate 17 is preferably made of an elastomer material, for example sealing rubber, in order to seal off backflow water from the drain 5. The sealer plate 17 can be considerably thicker than shown in the example of the embodiment.

In addition, an added support plate 18 can be provided between the cleaning head and the sealer plate, through which the sealer plate 17 can be pressed against the drain 5. However, it is also possible that the cleaning head 13 itself, together with the adjacent sealer plate 17, be pressed against the drain 5.

Referred to in FIGS. 2*b* and 4–6 are shown, among other things, the connecting adapter 7. This consists principally of a type of insulating hose, e.g. foam rubber or sponge rubber, etc., which has a consistency that is principally like foam rubber and thus has good flexibility and stability. Consequently, this connecting adapter 7 can be attached to the most widely differing water faucets without the need for individual adjustment of the connecting adapters to a particular water faucet. Thus, the connecting hose 9 can be simply attached to the connecting adapter 7, or it can be additionally secured with hose clamps that are not shown in detail. In order to increase the stability of the total assembly, an additional outer skin 25 can be provided in form of a rubber hose pulled over the outside.

The example of embodiment according to FIG. 2*b* shows the attachment of the connecting adapter 7 to the water faucet 9 by means of a clamping device that is fashioned in the form of a clamping sleeve 27.

Angle pieces 29*a* and 29*b*, shown schematically only, are provided at both ends of the clamping sleeve, and a screw 31 passes through them. Since angle pieces 29*b* has an internal screw thread, turning the screw 31 causes the sleeve to either contract or expand, which allows a tight connection of the connecting adapters to the water faucet.

Figure 4:
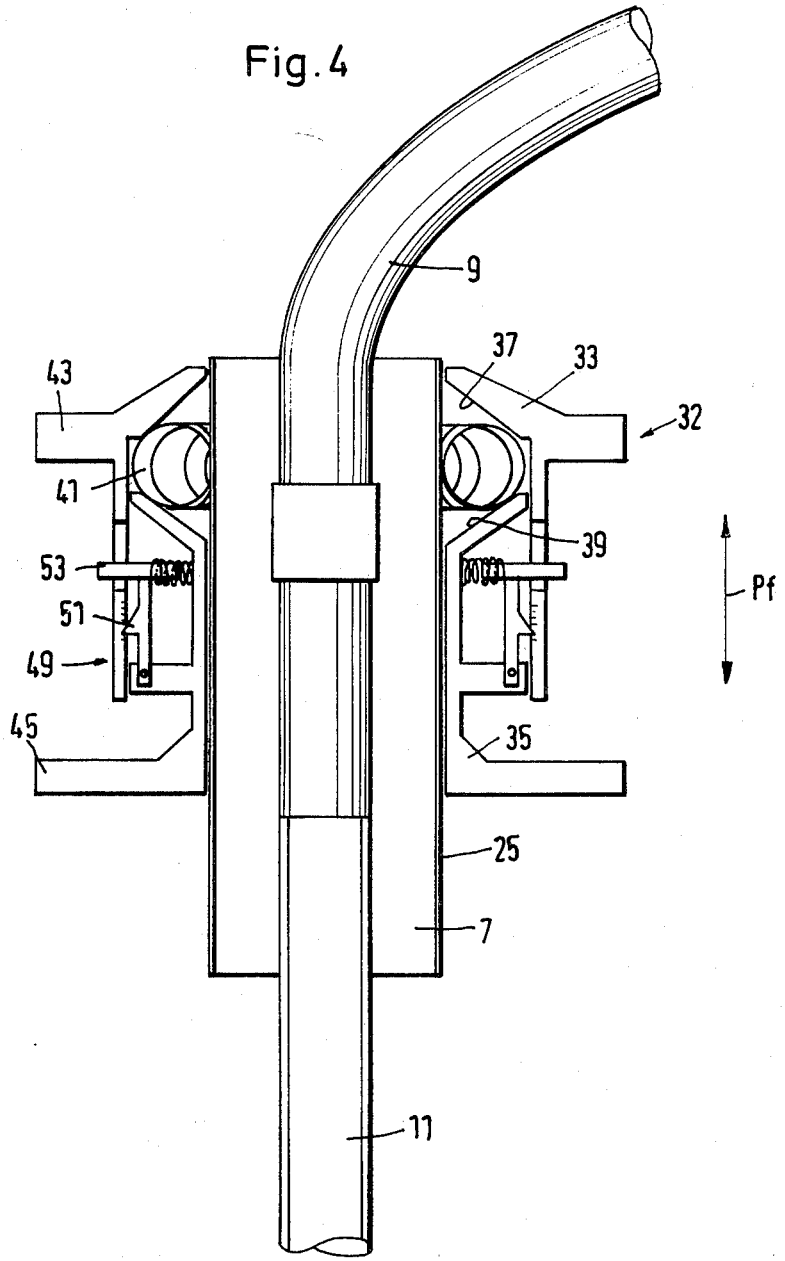

Shown in an alternative form of embodiment in accordance with FIG. 4 is a clamping device 32 that consists principally of two clamp segments 33 and 35 which can be moved axially toward each other, as indicated by the arrow Pf. Both clamp segments 33 and 35 contain contact surfaces 37 and 39 (inside) that converge conically outwardly, and between them is disposed a pressure member in the form of a steel spiral strap 41. Pressure on the two clamp segments 33 and 35 thus causes a vertical pressure movement to be exerted, as a horizontal pressure movement, on the connecting adapter 7, so that the latter is pressed firmly onto the water faucet 9. The conically converging, oblique contact surfaces can form an angle of, for example, approximately 100° between each other. This deflection causes the steel spiral strip spring 41, based on its spiral portions that shift uniformly into each other, to be compressed in such fashion that its inner diameter can be changed over a wide range. It is therefore possible to use this clamping device 32 also with the most widely differing water faucets, with dimensions that vary over a wide range.

In the example of embodiment shown in accordance with FIG. 4, the two clamp segments 33 and 35 are squeezed together simply by pressing the unlocking buttons 53 together and thereby pushing the two clamp segments apart again.

Figure 5:
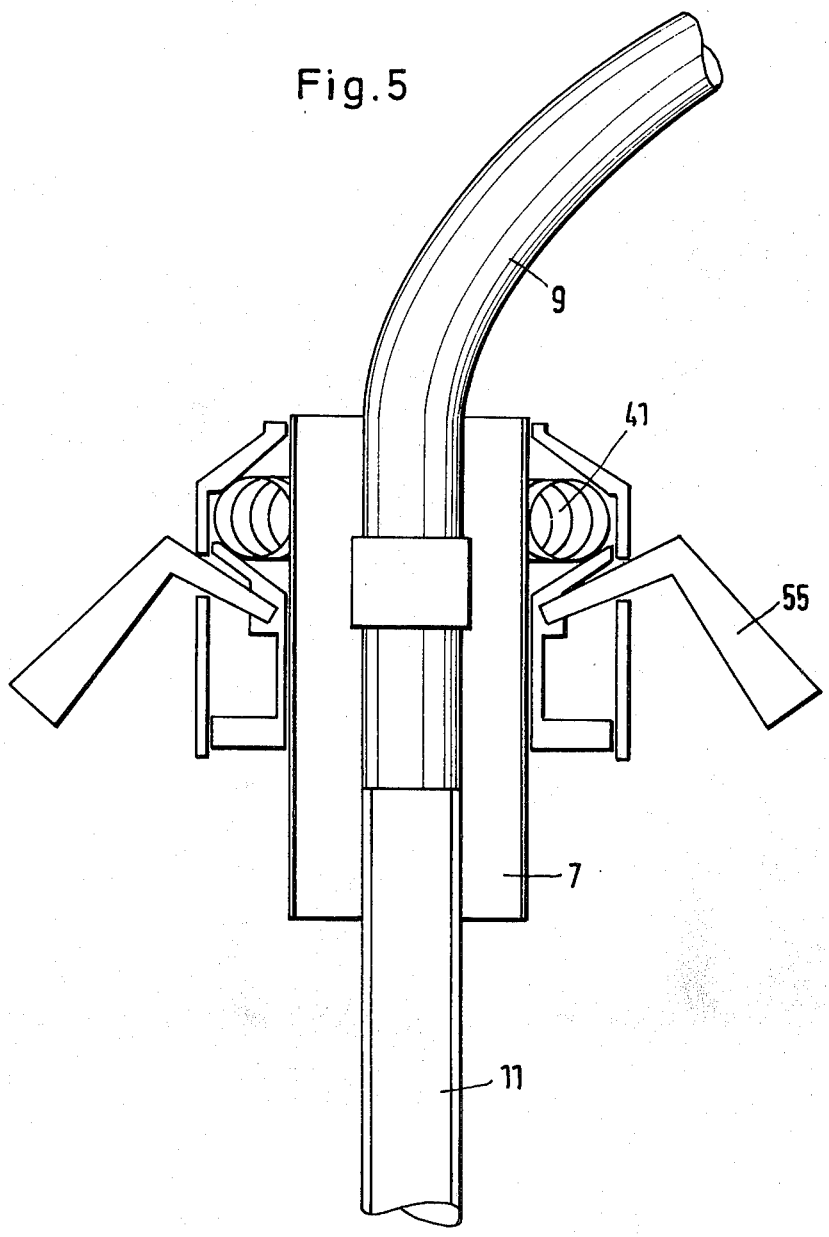

Shown in FIG. 5 is a different form of an embodiment of a clamping device where the axial movement of the two clamp segments toward each other is effected through separately provided levers 55. It is not shown in detail, but this embodiment is also equipped with a locking device 49, which, for example, can be located offset by 90° to the respective levers 55.

Figure 6:
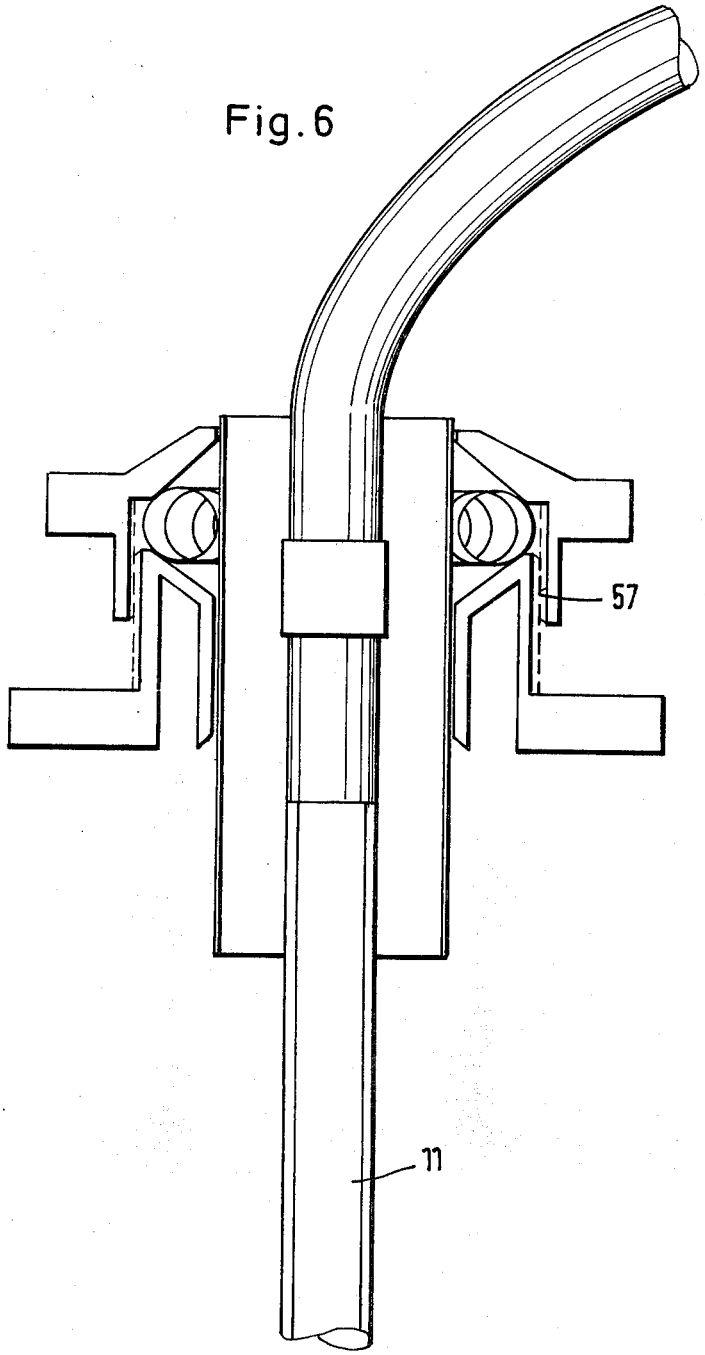

In the form of embodiment shown in FIG. 6, the application of the necessary clamping forces is ensured by the fact that the two clamp segments 33 and 35 can be screwed together by means of a thread 57. An additional locking device can be omitted in this case.

What is claimed is:

1. Water pressure jet cleaner means adapted for relieving clogged sink drains comprising:

(a) a connecting hose;

(b) a cleaning head coupled to a distal free end of the connecting hose for insertion into a clogged drain;

(c) a clamping device for detachably securing said connecting hose to a water faucet, said clamping device including a pair of clamping segments detachably secured to one another and arranged for axial positioning along said faucet relative to a spirally wound metallic strip and wherein said clamping segments include radially inwardly disposed contact surfaces converging radially outwardly from said clamping device and a pair of pivotally movable levers for generating a radially inwardly directed force against said contact surfaces and thereby against said metallic strip for compressively securing said clamping device to said faucet.

2. Water pressure jet cleaner means as defined in claim 1 being particularly characterized in that said clamping device further includes locking means for retaining said levers and thereby positionally fixing said clamping segments along said faucet.

3. Water pressure jet cleaner means for relieving clogged sink drains comprising:

(a) a connecting hose;

(b) a clamping device for detachably securing said connecting hose to a water faucet; and (c) a cleaning head arranged at a distal free end of the connecting hose and including a water discharge tube retention block and through which block the distal free end tip of at least one flexible water discharge tube passes in an axially adjustable fashion for permitting the tip(s) to be inserted into the drain, said at least one discharge tube being of a length, upon insertion, to reach the sink drain and down into the sink drain trap or siphon and whereby pressurized water from the faucet may be directly brought to bear against the clog.

4. Water pressure jet cleaner means as defined in claim 3 wherein the distal free end tip(s) of said water discharge tube(s) terminate along a bias.

5. Water pressure jet cleaner means as defined in claim 3 further including a drain sealer plate and through which plate said water discharge tube(s) also pass in an axially adjustable fashion and whereby said drain may be sealed when said water discharge tube(s) are brought to bear against a clog.

6. Water pressure jet cleaner means as defined in claim 5 wherein said drain sealer plate is fabricated of an elastomeric substance.

7. Water pressure jet cleaner means adapted for relieving clogged sink drains comprising:

(a) a connecting hose;

(b) a clamping device for detachably securing said connecting hose to a water faucet, said clamping device including a compressible spirally wound member, a clamping segment having a conically outwardly directed surface and means for bringing said conical surface to bear against said wound member and compressively urging said wound member against said faucet and whereby said clamping device is positionally fixed along said faucet; and (c) a cleaning head arranged at the distal free end of the connecting hose and including at least one flexible water discharge tube insertable into a clogged drain and whereby pressurized water from the faucet may be directly brought to bear against the clog.

8. Water pressure jet cleaner means adapted for relieving clogged sink drains comprising:

(a) a connecting hose;

(b) a clamping device for detachably securing said connecting hose to a water faucet and including a member having an aperture formed therein for mounting about said faucet, a clamping segment having a conically outwardly directed surface and means for bringing said conical surface to bear against the faucet mounted member, whereby said clamping device is positionally compressively secured to said faucet; and (c) a cleaning head arranged at the distal free end of the connecting hose, including at least one flexible water discharge tube insertable into a clogged drain and further including a sealing member mountable in the aperture to said drain and through which member the distal free end tip(s) of said water discharge tube(s) may be axially adjusted relative to a clog so as to seal said drain against backflow and pressure loss while ensuring that the tip(s) of said water discharge tube(s) remain in engagement with the clog.

* * * * *